US005330698A

United States Patent [19]

Allen et al.

[11] Patent Number: 5,330,698

[45] Date of Patent: Jul. 19, 1994

[54] PROCESS FOR MAKING HIGH ELONGATION PPD-T FIBERS

[75] Inventors: Steven R. Allen, Midlothian; David M. Harriss, Chesterfield, both of Va.

[73] Assignee: E. I. Du Pont de Nemours and Company, Wilmington, Del.

[21] Appl. No.: 47,392

[22] Filed: Apr. 19, 1993

[51] Int. Cl.[5] ..... D01D 5/06; D01D 10/06; D01F 6/60

[52] U.S. Cl. ..... 264/184; 264/234

[58] Field of Search ..... 264/184, 211.12, 211.14, 264/232, 234

[56] References Cited

U.S. PATENT DOCUMENTS

| | | | |
|---|---|---|---|
| 3,671,542 | 6/1972 | Kwolek | 524/157 |
| 3,767,756 | 10/1973 | Blades | 264/184 |
| 3,869,430 | 3/1975 | Blades | 264/184 X |
| 4,016,236 | 4/1977 | Nagasawa et al. | 264/184 |
| 4,320,081 | 3/1982 | Lammers | 264/184 |
| 4,466,935 | 8/1984 | Bair et al. | 264/184 |
| 4,859,393 | 8/1989 | Yang et al. | 264/184 |
| 4,898,704 | 2/1990 | Luckey | 264/184 X |

*Primary Examiner*—Leo B. Tentoni

[57] ABSTRACT

A process for making a PPD-T fiber having an elongation to break of greater than 7%.

6 Claims, No Drawings

PROCESS FOR MAKING HIGH ELONGATION PPD-T FIBERS

BACKGROUND OF THE INVENTION

1. Field of the Invention

This invention relates to fibers of poly(p-phenylene terephthalamide) (PPD-T) which exhibit textile properties, including an elongation to break of at least 7%. It, also, relates to the air-gap spinning process for making such fibers.

2. Description of the Prior Art

U.S. Pat. No. 3,671,542, issued Jun. 20, 1972 on the application of Kwolek, discloses a wet-spinning process for making para-aramid fibers by wet-spinning an anisotropic dope into a cold coagulation bath. Example 72 in that patent specifically discloses a high denier, low modulus, relatively low tenacity and high elongation PPD-T fiber; spun from a 10% anisotropic solution made by mixing low inherent viscosity polymer and 100.4% sulfuric acid to make a dope to be spun into a 4 C coagulation bath.

U.S. Pat. No. 3,767,756, issued Oct. 23, 1973 on the application of Blades, discloses a process for air-gap spinning PPD-T fibers.

U.S. Pat. No. 4,898,704 issued Feb. 6, 1990, on the application of Luckey, discloses a device and method for coagulating a warp of filaments from a linear spinneret by delivering a jetted sheet of coagulating liquid equally and uniformly to each side of the warp.

SUMMARY OF THE INVENTION

The present invention provides a process for making a textile quality para-aramid fiber with an elongation at break greater than 7%, comprising: (a) forming a spinning solution of 10 to 14 weight percent poly(p-phenylene terephthalamide) having an inherent viscosity of 4 dl/g and less in sulfuric acid of at least 90% concentration; (b) extruding the solution through capillaries in a spinneret, through a layer of inert non-coagulating fluid, and into an aqueous coagulating liquid to yield fibers; (c) maintaining separation of the fibers through the coagulating liquid and maintaining the temperature of the coagulating liquid at 40 to 80 degrees C; and, (d) drying the fibers under tension of 0 to 3 grams per denier.

DETAILED DESCRIPTION OF THE INVENTION

Wet spinning has long been used to produce textile fibers. However, wet spinning is notoriously slow. Thus, wet spinning processes must utilize spinnerets with a very large number of orifices to increase the production rate to an acceptable level. Air-gap spinning is known to produce high tenacity fibers with very high spinning speeds. Fibers made using air-gap spinning are generally highly oriented. The present invention relates to using a modified air-gap spinning method to make para-aramid fibers having a low molecular orientation and a, consequent, high elongation to break.

By "textile quality" is meant a fiber which can be used in filament, staple, or yarn form in woven or knit fabrics to yield the comfort, hand, flexibility, and aesthetics of traditional fabrics.

By "PPD-T" is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride. Preparation of PPD-T is well known and is described, for example, in U.S. Pat. Nos. 3,869,429; 4,308,374; and 4,698,414.

The PPD-T fibers of this invention are, as previously stated, of textile quality. This invention combines the heat resistant nature of PPD-T with the properties of textile quality yarns. The most significant properties of the fibers of this invention are the high elongation to break and the low modulus. High elongation is important as one element of a fiber leading to high toughness; and low modulus is important for lending hand and drape to fabrics made from the fibers.

The process of this invention is practiced with anisotropic spin solutions to obtain appropriately oriented fibers. In order to obtain, at the same time, fibers of textile qualities, including high elongation at break, the solution must have about 10 to 14 weight percent PPD-T; and the PPD-T must have an inherent viscosity of 4 or less than about 4 and more than about 1.5. It is believed that the high elongation fibers of this invention can be made only using PPD-T with an inherent viscosity from about 1.5 to about 4.

The spin solutions of this invention are made using sulfuric acid with a concentration of at least 90%, preferably 98%–100% or oleum containing up to as much as 20% or more of free $SO_3$. If sulfuric acid of lower or higher concentration is used, poor solution quality or excessive polymer degradation can result.

Spinning, in accordance with this invention, is conducted with the spin solution at 40° to 100° C. into a coagulating liquid at 40° to 80° C. Spin solutions must include PPD-T of an appropriate inherent viscosity in an appropriate concentration and spun under appropriate conditions to yield fibers which exhibit the high elongation of this invention.

The spin solution is extruded through capillaries in a spinneret. The capillaries in the spinneret can be arranged in straight lines to form a so-called linear spinneret or the capillaries can be arranged in concentric circles to form a radial spinneret. There are, of course, variations on those configurations. A spinneret might be used which has only a single capillary. In practice of this invention, freshly-spun individual filaments have a tendency to stick to each other in the coagulation bath; and it has been found useful to use a linear spinneret because, with a linear spinneret, the filaments can be more easily spaced apart and less likely to contact each other and stick together. In the fiber making process, it is seen as important to maintain a separation of the fibers to prevent them from sticking together. Separation of the fibers means that the filaments are not in such close proximity that they stick together.

The spinning solution is spun through a layer of inert non-coagulating fluid before it enters the coagulating liquid. The layer of inert non-coagulating fluid is commonly called the "air-gap" even though gases other than air can be used; and liquids which are inert can, also, be used. The air gap is 0.1 to 10 cm and preferably 0.5 to 5 cm thick.

After the air gap, the filaments enter the coagulating liquid. A wide variety of aqueous solutions which do not interfere with the coagulation process can be used for coagulation. For example, the coagulating liquid can be pure water or acid solutions of up to 70% $H_2SO_4$, or the coagulating liquid can be aqueous solutions of a variety of alcohols.

It is of critical importance to practice of this invention that the coagulating liquid for the anisotropic spinning solutions should be kept at a temperature of 40° to 80° C. and preferably 60° to 70° C.

While not necessary for the practice of this invention and not intended as any limitation on the invention, it is believed that the high elongation for fibers of this invention is achieved by coagulation at temperatures which allow greater relaxation or deorientation to occur during the coagulation process than is allowed at lower temperatures. Coagulation of anisotropic spinning solution at temperatures less than about 35°-40° C. leads to too high a degree of orientation and high modulus and low elongation; and yields fibers which exhibit less than the desired 7% elongation at break. Coagulation at temperatures above about 90°-100° C. provides the desired poor orientation, low modulus and high elongation but leads to excessive filament sticking when a large number of filaments is being spun.

Once coagulated, the filaments are dried at moderate temperatures and under low or no tension, generally less than 3 grams per denier. The temperature of drying is generally from 100 to 200 C.; but could be as low as 25° C. or even lower. High drying temperatures or tensions results in high crystallization and fiber drawing which increases orientation and reduces elongation to break.

Test Methods

Inherent Viscosity. Inherent Viscosity (IV) is defined by the equation:

$$IV = ln(\eta_{rel})/c$$

where c is the concentration (0.5 gram of polymer in 100 ml of solvent) of the polymer solution and $\eta_{rel}$ (relative viscosity) is the ratio between the flow times of the polymer solution and the solvent as measured at 30° C. in a capillary viscometer. The inherent viscosity values reported and specified herein are determined using concentrated sulfuric acid (96% $H_2SO_4$).

Tensile Properties. Yarns tested for tensile properties are, first, twisted to a twist multiplier of 1.1. The twist multiplier (TM) of a yarn is defined as:

$$TM = (\text{twists/inch})/(5315/\text{denier of yarn})^{-1/2}$$

Tenacity (breaking tenacity), elongation (breaking elongation), and modulus are determined by breaking test yarns on an Instron Tester (Instron Engineering Corp., Canton, Mass.). Filaments are tested without twist.

Tenacity, elongation, and initial modulus, as defined in ASTM D2101-1985, are determined using yarn gage lengths of 25.4 cm and an elongation rate of 10% strain/minute. The modulus is calculated from the steepest slope of the stress-strain curve.

DESCRIPTION OF THE PREFERRED EMBODIMENTS

Example 1

This example illustrates the effect on the fiber properties of PPD-T polymer concentration in the spinning solution. Fibers were spun from a linear spinneret with 1000 holes of a 2.5 mil diameter, through an air gap, and coagulated with pure water. Each batch of polymer solution consisted of 100.4% sulfuric acid and PPD-T with an initial inherent viscosity of 5.5. Fibers were first spun with the polymer not degraded, and then with two different stages of polymer degradation. All spinning solutions were anisotropic. All fibers were dried in skeins at zero tension.

| Item | IV | % Solids | Spin Temp | Coag. Temp | Ten (gpd) | Elg (%) | Mod (gpd) |
|---|---|---|---|---|---|---|---|
| 1-A | 5.12 | 19.3 | 80 | 2 | 20 | 3.8 | 426 |
| 1-B | 5.24 | 19.3 | 80 | 20 | 19.9 | 4.0 | 377 |
| 1-C | ~5.1 | 19.3 | 80 | 40 | 19.2 | 4.2 | 390 |
| 1-D | 4.86 | 12.0 | 80 | 2 | 11.8 | 4.7 | 364 |
| 1-E | ~5.1 | 12.0 | 80 | 40 | 10.0 | 6.8 | 266 |
| 1-F | 5.35 | 12.0 | 80 | 60 | 9.9 | 6.9 | 267 |
| 1-G | 5.03 | 12.0 | 80 | 75 | 7.9 | 6.2 | 250 |
| 1-H | ~3.6 | 12.0 | 80 | 75 | 7.8 | 8.5 | 207 |
| 1-I | 3.47 | 12.0 | 80 | 60 | 8.4 | 8.5 | 210 |
| 1-J | 3.73 | 12.0 | 100 | 60 | 8.3 | 9.2 | 215 |
| 1-K | 3.44 | 12.0 | 100 | 2 | 8.0 | 5.9 | 239 |
| 1-L | 4.17 | 16.0 | 90 | 60 | 10.1 | 5.3 | 323 |
| 1-M | 4.46 | 16.0 | 100 | 60 | 9.7 | 4.9 | 343 |
| 1-N | ~4.3 | 16.0 | 100 | 2 | 10.7 | 4.3 | 327 |

It is noted that, only items 1-H through 1-J of this example represent practice of this invention. Only those items exhibit an elongation to break of greater than 7%. Any item which had any of inherent viscosity (IV 1.5-4.0), % Solids (10-14%), or Coag. Temp. (40-80 C) outside of the required anisotropic ranges of this invention, yielded a fiber product with less than 7% elongation.

Example 2

This example shows the effect of narrow polymer concentration changes on elongation and modulus of the fiber. Fibers spun from several solution concentrations were air-gap spun using the linear spinneret of Example 1; the polymer solution was made from 100.4% sulfuric acid and PPD-T with an inherent viscosity of 2.5-3.0 and the solution was anisotropic. As percent solids was increased, the modulus of the fiber increased, and the elongation decreased. All fibers were dried in skeins at zero tension.

| Item | IV | % Solids | Spin Temp | Coag. Temp | Ten (gpd) | Elg (%) | Mod (gpd) |
|---|---|---|---|---|---|---|---|
| 2-A | 2.5-3 | 11.5 | 90 | 60 | 5.6 | 9.6 | 127 |
| 2-B | 2.5-3 | 11.9 | 90 | 60 | 6.2 | 8.2 | 166 |
| 2-C | 2.5-3 | 12.4 | 90 | 60 | 6.2 | 7.9 | 172 |

Example 3

This example shows the effect of spin solution temperature, coagulation temperature, and low inherent viscosity polymer on fiber properties using a radial spinneret. A 12% anisotropic solution of 2.31 inherent viscosity PPD-T was air gap spun through a 2.5 mil, 266 hole, radial spinneret. During this spin, filaments often stuck together and the sticking became a substantial problem. All fibers were dried in skeins at zero tension.

| Item | Denier | Spin Temp | Coag. Temp | Ten (gpd) | Elong (%) | Modulus (gpd) |
|---|---|---|---|---|---|---|
| 3-A | 421 | 60 | 50 | 5.5 | 9.1 | 185 |
| 3-B | 409 | 80 | 20 | 3.6 | 4.3 | 179 |
| 3-C | 405 | 80 | 50 | 5.2 | 9.3 | 204 |

Example 4

This example illustrates the invention in the desired range of inherent viscosity and solution and quenching temperatures. 12.1% PPD-T in 100.1% sulfuric acid was spun as an anisotropic solution from the linear spinneret of Example 1 and the fibers were coagulated in pure water. As is shown, higher solution and higher quench temperatures result in higher elongation values. All fibers were dried in skeins at zero tension.

| Item | Denier | Spin Temp | Coag. Temp | Inh Visc. | Ten. (gpd) | Elg (%) | Mod (gpd) |
|---|---|---|---|---|---|---|---|
| 4-A | 1692 | 80 | 60 | 2.58 | 6.6 | 9.2 | 158 |
| 4-B | 1672 | 80 | 60 | 2.58 | 6.5 | 9.4 | 156 |
| 4-C | 1667 | 90 | 60 | 2.58 | 6.6 | 9.7 | 157 |
| 4-D | 1658 | 90 | 60 | 2.58 | 6.4 | 9.0 | 172 |
| 4-E | 1695 | 60 | 60 | 2.58 | 6.5 | 8.7 | 161 |
| 4-F | 1640 | 60 | 60 | 2.58 | 6.8 | 8.8 | 174 |
| 4-G | 1089 | 90 | 60 | 2.58 | 6.0 | 8.4 | 190 |
| 4-H | 1661 | 100 | 60 | 2.40 | 6.2 | 10.3 | 156 |
| 4-I | 1654 | 100 | 60 | 2.40 | 6.4 | 10.5 | 157 |
| 4-J | 1680 | 90 | 40 | 2.40 | 6.1 | 8.1 | 190 |
| 4-K | 1667 | 90 | 40 | 2.40 | 6.1 | 8.4 | 176 |
| 4-L | 1663 | 80 | 40 | 2.40 | 6.4 | 8.2 | 184 |
| 4-M | 1696 | 80 | 40 | 2.40 | 6.1 | 8.0 | 173 |
| 4-N | 1664 | 60 | 40 | 2.40 | 6.4 | 7.6 | 198 |
| 4-O | 1662 | 80 | 20 | 2.73 | 5.5 | 5.7 | 202 |

Note that there is one item, coagulated at only 20° C., that does not represent this invention because the resulting fiber does not have an elongation of greater than 7%.

Example 5

This example further illustrates the effect of solution solids and inherent viscosity of fiber properties when using anisotropic spinning solutions made from 100.4% sulfuric acid and PPD-T. Fibers were spun from linear spinnerets with a coagulation temperature of 45 C. All fibers were dried in skeins at zero tension.

| Item IV | % Solids | Coag. Temp | Inh Visc. | Ten (gpd) | Elg (%) | Mod (gpd) |
|---|---|---|---|---|---|---|
| 5-A | 12.0 | 45C | 3.42 | 9.7 | 9.4 | 221 |
| 5-B | 12.0 | 45 | 2.60 | 8.4 | 10.4 | 205 |
| 5-C | 12.0 | 45 | 1.72 | 4.0 | 11.8 | 103 |
| 5-D | 10.4 | 45 | 2.25 | 6.5 | 11.5 | 159 |
| 5-E | 10.5 | 45 | 2.08 | 5.1 | 15.4 | 111 |

We claim:

1. A process for making a textile quality para-aramid fiber with an elongation at break greater than 7%, comprising:

(a) forming a spinning solution of 10 to 14 weight percent poly(p-phenylene terephthalamide) having an inherent viscosity of up to 4 dl/g in sulfuric acid of at least 90% concentration;

(b) extruding the solution through capillaries in a spinneret, through a layer of inert non-coagulating fluid, and into an aqueous coagulating liquid to yield fibers; and (c) maintaining separation of the fibers through the coagulating liquid and maintaining the temperature of the coagulating liquid at a temperature of from 40 to 80 degrees C.

2. The process of claim 1 wherein there is an additional step, (d) drying the fibers under tension of less than 3 grams per denier.

3. The process of claim 1 wherein the spin solution is anisotropic.

4. The process of claim 1 wherein the spinneret has a linear array of capillaries.

5. The process of claim 1 wherein the spin solution is maintained at a temperature of 40–100 degrees C.

6. The process of claim 1 wherein the inherent viscosity of the poly(p-phenylene terephthalamide) is 1.5–4 dl/g.

* * * * *